US007329092B2

(12) United States Patent
Keener et al.

(10) Patent No.: US 7,329,092 B2
(45) Date of Patent: Feb. 12, 2008

(54) STATOR BLADE AIRFOIL PROFILE FOR A COMPRESSOR

(75) Inventors: Christopher P. Keener, Simpsonville, SC (US); David J Stampfli, Greer, SC (US)

(73) Assignee: General Electric Company, Schenectady, NY (US)

( * ) Notice: Subject to any disclaimer, the term of this patent is extended or adjusted under 35 U.S.C. 154(b) by 178 days.

(21) Appl. No.: 11/340,532

(22) Filed: Jan. 27, 2006

(65) Prior Publication Data

US 2007/0177980 A1 Aug. 2, 2007

(51) Int. Cl.
*F01D 9/00* (2006.01)

(52) U.S. Cl. ..... 415/191; 416/223 A; 416/DIG. 2

(58) Field of Classification Search ..... None
See application file for complete search history.

(56) References Cited

U.S. PATENT DOCUMENTS 5,980,209 A * 11/1999 Barry et al. ..... 416/223 A
6,398,489 B1 * 6/2002 Burdgick et al. ..... 415/115
6,450,770 B1 * 9/2002 Wang et al. ..... 416/223 A
6,461,109 B1 * 10/2002 Wedlake et al. ..... 416/223 R
6,461,110 B1 * 10/2002 By et al. ..... 416/223 A
6,474,948 B1 * 11/2002 Pirolla et al. ..... 416/243
6,503,054 B1 * 1/2003 Bielek et al. ..... 415/191
6,503,059 B1 * 1/2003 Frost et al. ..... 416/223 A
6,558,122 B1 * 5/2003 Xu et al. ..... 416/223 A
6,685,434 B1 * 2/2004 Humanchuk et al. ... 416/223 A
6,715,990 B1 * 4/2004 Arness et al. ..... 416/223 A
6,722,852 B1 * 4/2004 Wedlake et al. ..... 416/223 A
6,722,853 B1 * 4/2004 Humanchuk et al. ... 416/223 A
6,736,599 B1 * 5/2004 Jacks et al. ..... 415/191
6,739,838 B1 * 5/2004 Bielek et al. ..... 416/223 A
6,739,839 B1 * 5/2004 Brown et al. ..... 416/223 A
6,769,878 B1 * 8/2004 Parker et al. ..... 416/243
6,769,879 B1 * 8/2004 Cleveland et al. ..... 416/243
6,779,977 B2 * 8/2004 Lagrange et al. ..... 416/223 A
6,779,980 B1 * 8/2004 Brittingham et al. ..... 416/243
6,808,368 B1 * 10/2004 Tomberg et al. ..... 416/223 A
6,832,897 B2 * 12/2004 Urban ..... 416/223 A
6,854,961 B2 * 2/2005 Zhang et al. ..... 416/223 A
6,857,855 B1 * 2/2005 Snook et al. ..... 416/223 A
6,866,477 B2 * 3/2005 Arness et al. ..... 415/191

(Continued)

OTHER PUBLICATIONS

U.S. Appl. No. 10/900,200, filed Jul. 28, 2004, entitled: Airfoil Shape and Sidewall Flowpath Surfaces for a Turbine Nozzle.

(Continued)

*Primary Examiner*—Richard A. Edgar
(74) *Attorney, Agent, or Firm*—Nixon & Vanderhye, PC

(57) ABSTRACT

Twelfth stage stator vanes for a compressor comprise airfoil profiles substantially in accordance with Cartesian coordinate values of Z, Y and Z set forth in inches in Table I, wherein the Z coordinate values are perpendicular distances from planes normal to a radius from the compressor centerline and containing the X and Y values with the Z value commencing at zero in the X, Y plane at a radial aerodynamic section of the airfoil. X and Y are coordinate values defining the airfoil profile at each distance Z. The X, Y and Z values may be scaled to provide a scaled-up or scaled-down airfoil section for each stator vane.

12 Claims, 6 Drawing Sheets

U.S. PATENT DOCUMENTS 6,881,038 B1 * 4/2005 Beddard et al. ..... 416/243
6,884,038 B2 * 4/2005 Hyde et al. ..... 416/223 A
6,887,041 B2 * 5/2005 Coke et al. ..... 415/191
6,910,868 B2 * 6/2005 Hyde et al. ..... 416/223 R
6,932,577 B2 * 8/2005 Strohl et al. ..... 416/223 A
7,001,147 B1 * 2/2006 Phillips et al. ..... 415/191
7,094,034 B2 * 8/2006 Fukuda et al. ..... 416/223 A
7,186,090 B2 * 3/2007 Tomberg et al. ..... 416/223 A
2003/0017052 A1 * 1/2003 Frost et al. ..... 416/223 A
2003/0021680 A1 * 1/2003 Bielek et al. ..... 415/191
2004/0057833 A1 * 3/2004 Arness et al. ..... 416/243
2004/0115058 A1 * 6/2004 Lagrange et al. ..... 416/223 A
2004/0175271 A1 * 9/2004 Coke et al. ..... 416/223 A
2004/0223849 A1 * 11/2004 Urban ..... 416/223 A
2004/0241002 A1 * 12/2004 Zhang et al. ..... 416/223 A
2005/0013692 A1 * 1/2005 Snook et al. ..... 416/191
2005/0013695 A1 * 1/2005 Hyde et al. ..... 416/243
2005/0019160 A1 * 1/2005 Hyde et al. ..... 415/213.1
2005/0025618 A1 * 2/2005 Arness et al. ..... 415/191
2005/0031453 A1 * 2/2005 Snook et al. ..... 416/223 A
2005/0079061 A1 * 4/2005 Beddard et al. ..... 416/243
2006/0024159 A1 * 2/2006 Phillips et al. ..... 415/191
2006/0073014 A1 * 4/2006 Tomberg et al. ..... 416/96 R
2006/0216144 A1 * 9/2006 Sullivan et al. ..... 415/191
2007/0048143 A1 * 3/2007 Noshi ..... 416/223 R
2007/0154316 A1 * 7/2007 Clarke ..... 416/223 R
2007/0154318 A1 * 7/2007 Saltman et al. ..... 416/241 R
2007/0177980 A1 * 8/2007 Keener et al. ..... 416/223 R
2007/0177981 A1 * 8/2007 Vandeputte et al. .... 416/223 R
2007/0183895 A1 * 8/2007 Sheffield ..... 416/223 R
2007/0183896 A1 * 8/2007 Jay et al. ..... 416/223 R
2007/0183897 A1 * 8/2007 Sadler et al. ..... 416/223 R
2007/0183898 A1 * 8/2007 Hurst et al. ..... 416/223 R
2007/0201983 A1 * 8/2007 Arinci et al. ..... 416/223 R
2007/0207035 A1 * 9/2007 Girgis et al. ..... 416/223 A
2007/0207036 A1 * 9/2007 Girgis et al. ..... 416/223 A
2007/0207037 A1 * 9/2007 Girgis et al. ..... 416/223 A
2007/0207038 A1 * 9/2007 Girgis et al. ..... 416/223 A

OTHER PUBLICATIONS

U.S. Appl. No. 10/853,240, filed May 26, 2004, entitled: Internal Core Profile for a Turbine Nozzle Airfoil.
U.S. Appl. No. 10/986,162, filed Nov. 12, 2004, entitled: Airfoil Shape for a Compressor Blade.
U.S. Appl. No. 11/226,264, filed Sep. 15, 2004, entitled: Rotor Blade for a First Phase of a Gas Turbine.

* cited by examiner

STATOR BLADE AIRFOIL PROFILE FOR A COMPRESSOR

BACKGROUND OF THE INVENTION

The present invention relates to a compressor for a turbine and particularly relates to a stator blade airfoil profile for the compressor blades, particularly the twelfth stage blades.

The flow path of a compressor requires compressor airfoil stator blade profiles that meet system requirements of efficiency and loading. The airfoil shape of the compressor stator blades must optimize the interaction between other stages in the compressor, provide for aerodynamic efficiency and optimize aeromechanic life objectives. Accordingly, there is a need for a stator blade airfoil profile which optimizes these objectives.

BRIEF SUMMARY OF THE INVENTION

In a preferred embodiment of the invention, a stator blade for a compressor having an airfoil, the airfoil having a shape in an envelope within ±0.100 inches in a direction normal to any airfoil surface location wherein the airfoil has an uncoated nominal profile substantially in accordance with Cartesian coordinate values of X, Y and Z set forth in inches in Table I wherein the Z coordinate values are perpendicular distances from planes normal to a radius from the compressor centerline and containing the X and Y values with the Z value commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil shape.

In another preferred embodiment of the invention, a stator blade for a compressor having an airfoil, the airfoil having an uncoated nominal airfoil profile substantially in accordance with Cartesian coordinate values of X, Y and Z set forth in inches in Table I, wherein the Z coordinate values are perpendicular distances from planes normal to a radius from the compressor centerline and containing the X and Y values with the Z values commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil profile, the X, Y and Z values being scaled as a function of the same constant or number to provide a scaled-up or scaled-down compressor airfoil.

In a further preferred embodiment of the invention, a compressor comprising a plurality of stator blades forming a portion of a compressor stage, each of said blades being in the shape of an airfoil within ±0.100 inches in a direction normal to any airfoil surface location wherein the airfoil has an uncoated nominal profile substantially in accordance with Cartesian coordinate values of X, Y and Z set forth in inches in Table I, wherein the Z coordinate values are perpendicular distances from planes normal to a radius from the compressor centerline and containing the X and Y values with the Z values commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil shape.

In another preferred embodiment of the invention a compressor comprising a plurality of stator blades forming a portion of a compressor stage, each of said blades having an uncoated nominal profile substantially in accordance with Cartesian coordinate values of X, Y and Z set forth in inches in Table I, wherein the Z coordinate values are perpendicular distances from planes normal to a radius from the compressor centerline and containing the X and Y values with the Z value commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil profile, the X, Y and Z values being scaled as a function of the same constant or number to provide a scaled-up or scaled-down compressor airfoil.

DETAILED DESCRIPTION OF THE INVENTION

Figure 1:
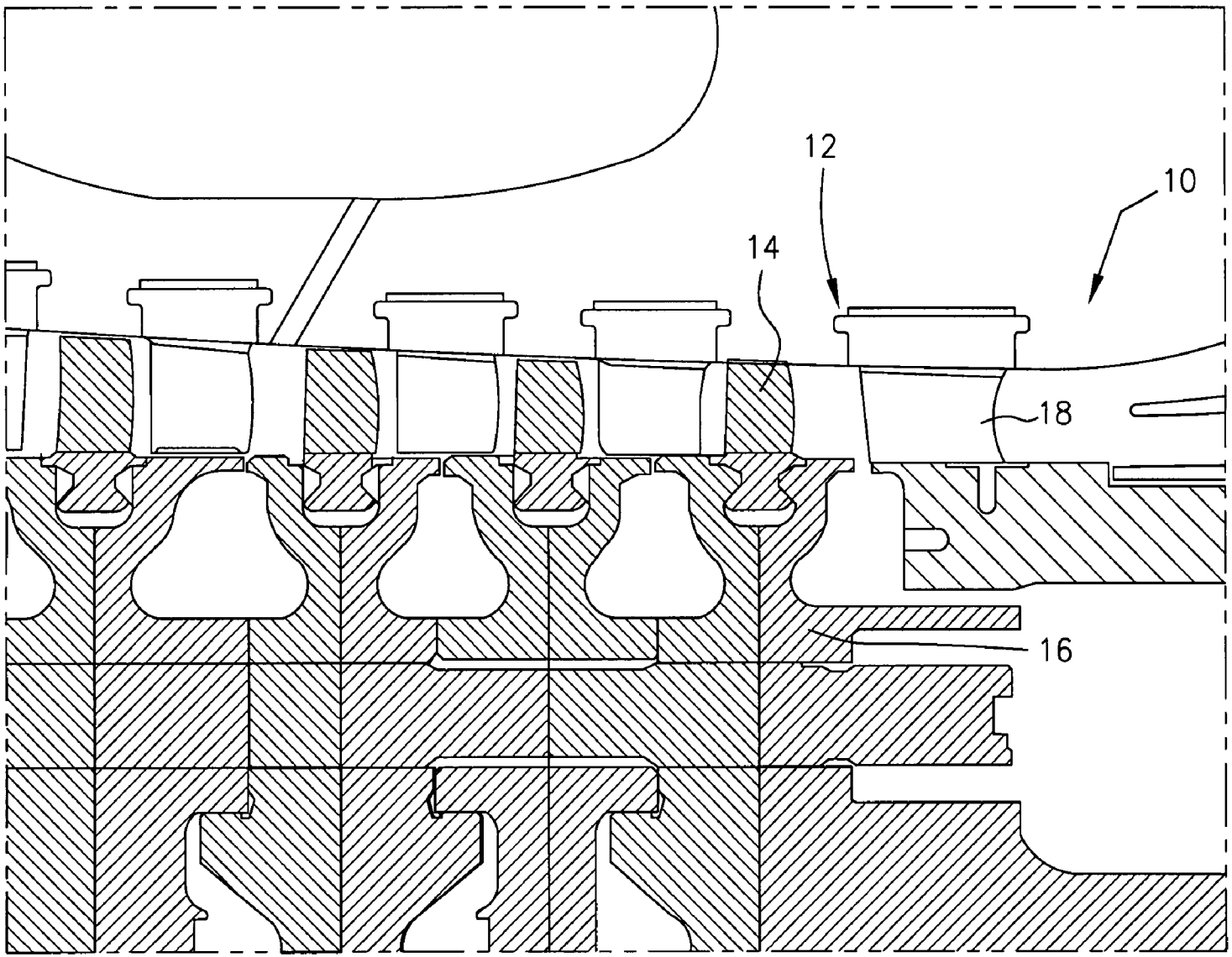
FIG. 1 is a fragmentary cross-sectional view of a compressor illustrating various stages of the compressor including the twelfth stage.
Figure 2:
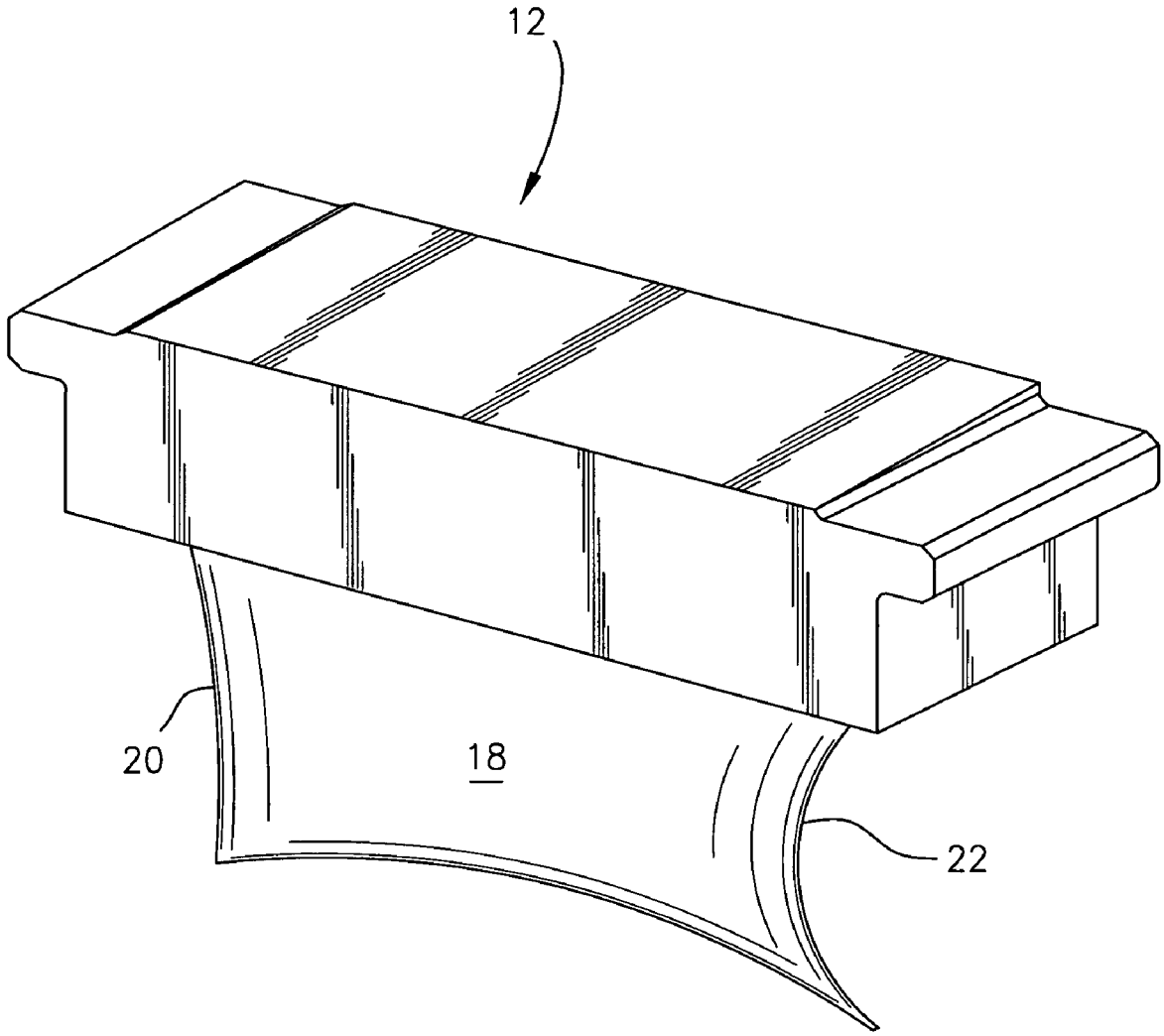
FIG. 2 is perspective view of a blade for the twelfth stage of the compressor.
Figure 3:
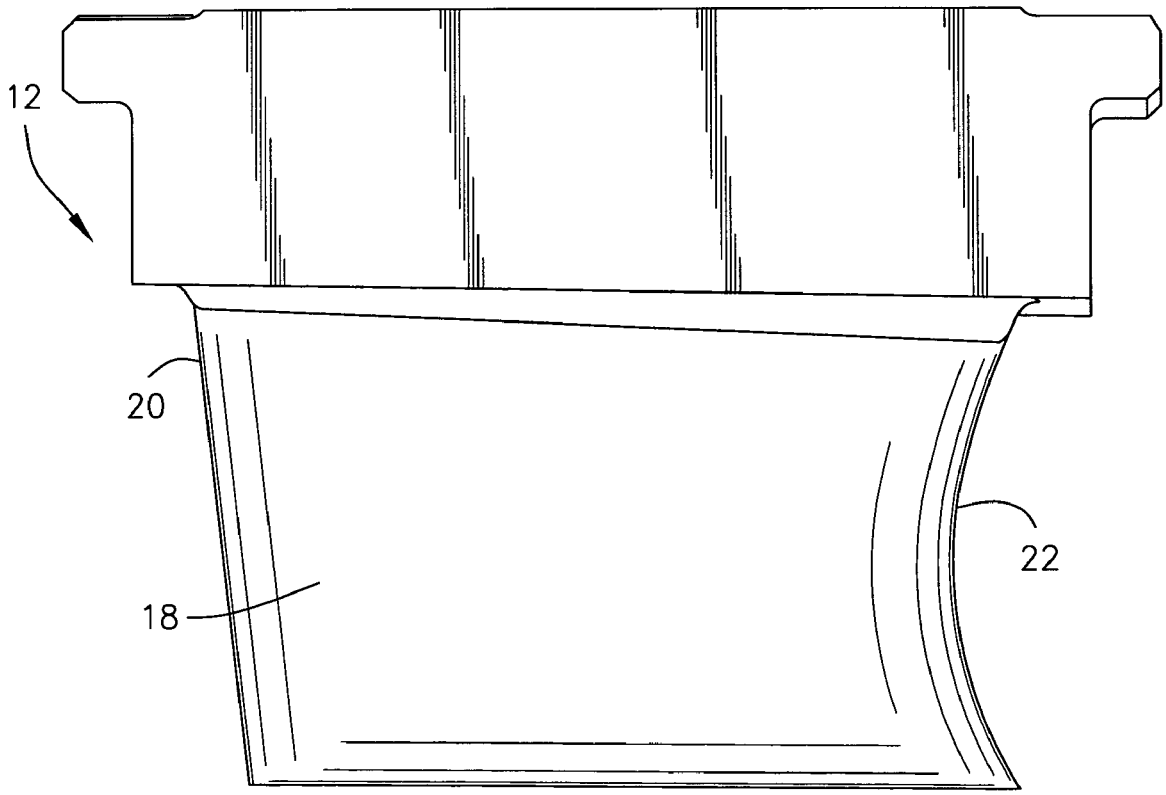
FIG. 3 is a side elevational view thereof.
Figure 4:
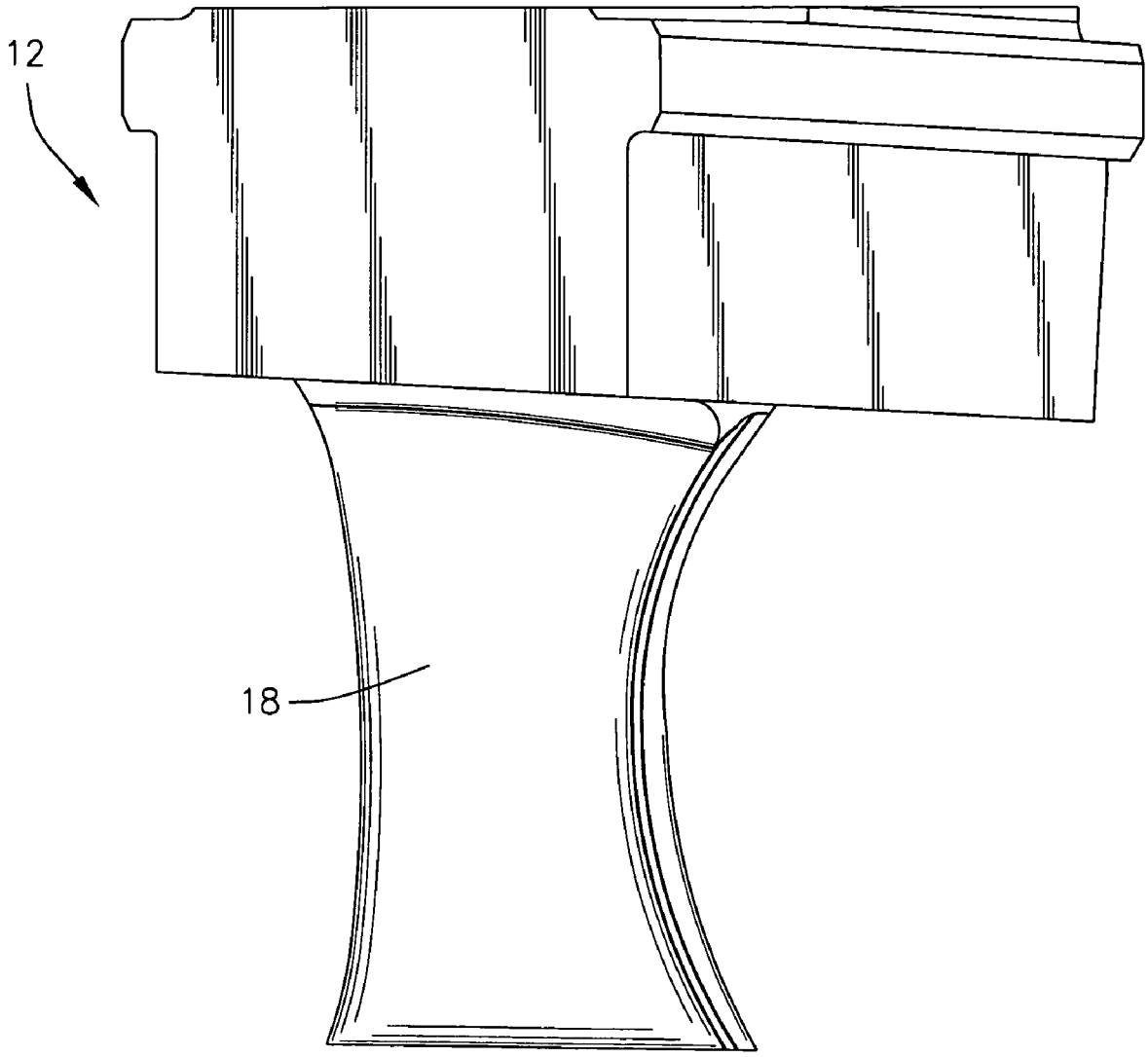
FIG. 4 is a tangential and rear perspective view of the twelfth stage compressor blade.
Figure 5:
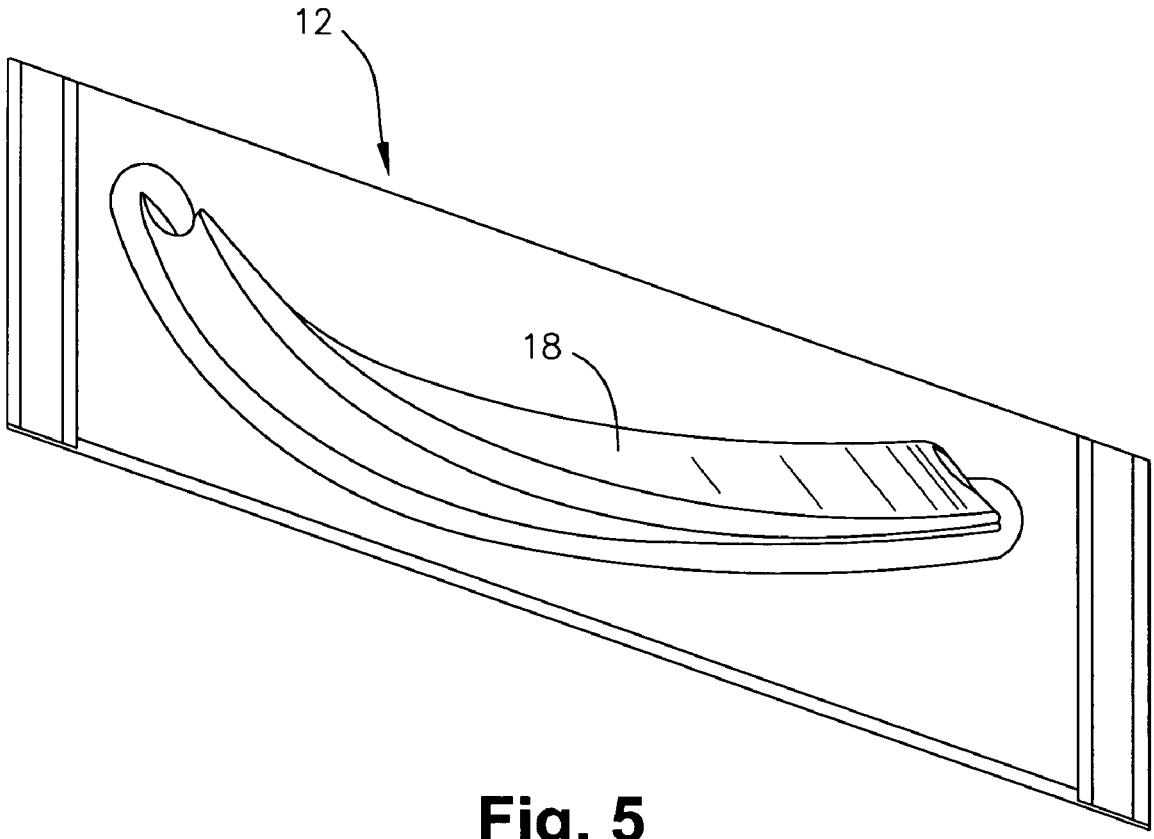
FIG. 5 is a end view of the twelfth stage compressor blade as viewed looking radially outwardly from the blade tip.
Figure 6:
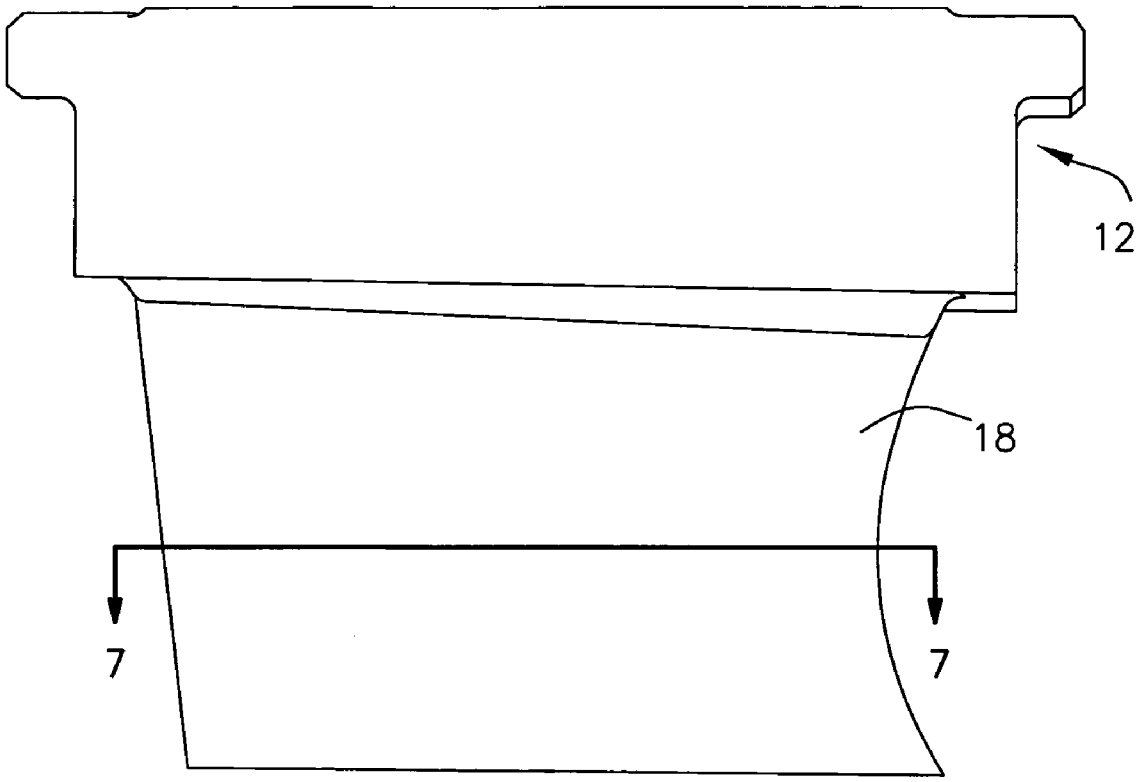
FIG. 6 is a view similar to FIG. 2.
Figure 7:
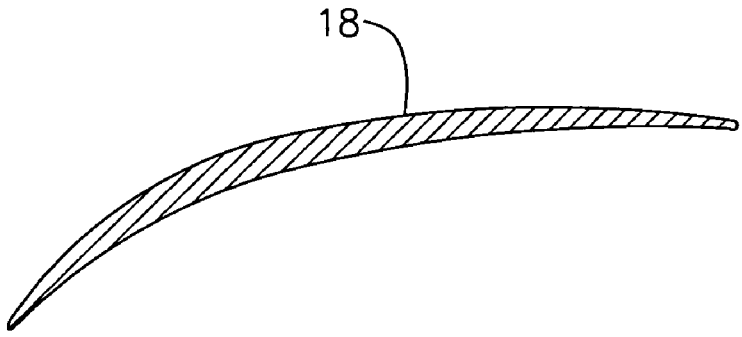
FIG. 7 is a cross-sectional view thereof taken generally about on line 7-7 in FIG. 6.

Referring now to FIG. 1, there is illustrated a portion of a compressor, generally designated 10, having multiple stages including a twelfth stage, generally designated 12. Each stage includes a plurality of circumferentially spaced stator blades, as well as rotor blades 14 mounted on the compressor rotor 16. The twelfth stage compressor stator blades 12 are circumferentially spaced one from the other, having airfoils 18 of a particular airfoil shape or profile specified below. Referring to FIG. 2, the airfoil shape or profile includes leading and trailing edges 20 and 22, respectively. In the preferred and illustrated embodiment of the twelfth stage compressor stator vanes, there are 113 vanes forming the twelfth stage.

Referring now to FIGS. 2-7, each of the twelfth stage stator blades has an airfoil profile defined by a Cartesian coordinate system for X, Y and Z values. The coordinate values are set forth in inches in Table I below. The Cartesian coordinate system includes orthogonally related X, Y and Z axes with the Z axis extending along a radius from the centerline of the compressor rotor, i.e., normal to a plane containing the X and Y values. The Z distance commences at zero in the X, Y plane at the radially outermost aerodynamic section. This Z distance, i.e., Z=0, is located on a radius 17.114 inches from the compressor centerline. The X axis lies parallel to the compressor rotor centerline, i.e., the rotary axis. By defining X and Y coordinate values at selected locations in a Z direction normal to the X, Y plane, the profile of airfoil 20 can be ascertained. By connecting the X and Y values with smooth continuing arcs, each profile section at each distance Z is fixed. The surface profiles at the various surface locations between the distances Z are connected smoothly to one another to form the airfoil. The tabular values given in Table I below are in inches and represent airfoil profiles at ambient, non-operating or non-hot conditions and are for an uncoated airfoil. The sign convention assigns a positive value Z in a radially inward direction and positive and negative values for the X and Y coordinate values as typically used in Cartesian coordinate systems.

The 1,232 points are a nominal cold or room-temperature profile for each cross-section of the airfoil.

There are typical manufacturing tolerances, as well as coatings which must be accounted for in the actual profile of the airfoil. Accordingly, the values for the profile given in Table I are for a nominal airfoil. It will therefore be appreciated that typical manufacturing tolerances, i.e., ±values and coating thicknesses are additive to or subtractive from the X, Y values given in Table I below. Accordingly, a distance of ±0.100 inches in a direction normal to any surface location along the airfoil profile, defines an airfoil profile envelope for this particular airfoil design and compressor. A significant advantage of the blade design is that sufficient margin between the natural frequencies of the airfoil and any known drivers under operating conditions is achieved. In a preferred embodiment, the vane airfoil profiles given in Table I below are for the twelfth stage blades of the compressor.

The coordinate values given in Table I below are in inches and provide the preferred nominal profile envelope.

| X-LOC | Y-LOC | Z-LOC |
|---|---|---|
| 1.447 | −0.788 | 0.000 |
| 1.447 | −0.789 | 0.000 |
| 1.447 | −0.792 | 0.000 |
| 1.445 | −0.796 | 0.000 |
| 1.440 | −0.801 | 0.000 |
| 1.428 | −0.804 | 0.000 |
| 1.411 | −0.805 | 0.000 |
| 1.388 | −0.808 | 0.000 |
| 1.359 | −0.811 | 0.000 |
| 1.322 | −0.815 | 0.000 |
| 1.279 | −0.820 | 0.000 |
| 1.233 | −0.825 | 0.000 |
| 1.182 | −0.831 | 0.000 |
| 1.124 | −0.837 | 0.000 |
| 1.061 | −0.844 | 0.000 |
| 0.995 | −0.850 | 0.000 |
| 0.926 | −0.855 | 0.000 |
| 0.855 | −0.860 | 0.000 |
| 0.780 | −0.863 | 0.000 |
| 0.703 | −0.865 | 0.000 |
| 0.623 | −0.864 | 0.000 |
| 0.540 | −0.861 | 0.000 |
| 0.455 | −0.855 | 0.000 |
| 0.369 | −0.845 | 0.000 |
| 0.284 | −0.833 | 0.000 |
| 0.199 | −0.816 | 0.000 |
| 0.115 | −0.795 | 0.000 |
| 0.032 | −0.771 | 0.000 |
| −0.049 | −0.742 | 0.000 |
| −0.128 | −0.710 | 0.000 |
| −0.206 | −0.674 | 0.000 |
| −0.283 | −0.634 | 0.000 |
| −0.357 | −0.590 | 0.000 |
| −0.429 | −0.542 | 0.000 |
| −0.495 | −0.491 | 0.000 |
| −0.556 | −0.438 | 0.000 |
| −0.610 | −0.384 | 0.000 |
| −0.660 | −0.328 | 0.000 |
| −0.706 | −0.271 | 0.000 |
| −0.746 | −0.215 | 0.000 |
| −0.782 | −0.159 | 0.000 |
| −0.812 | −0.107 | 0.000 |
| −0.837 | −0.058 | 0.000 |
| −0.857 | −0.013 | 0.000 |
| −0.874 | 0.027 | 0.000 |
| −0.887 | 0.062 | 0.000 |
| −0.896 | 0.093 | 0.000 |
| −0.903 | 0.119 | 0.000 |

-continued

| X-LOC | Y-LOC | Z-LOC |
|---|---|---|
| −0.908 | 0.142 | 0.000 |
| −0.911 | 0.160 | 0.000 |
| −0.912 | 0.175 | 0.000 |
| −0.911 | 0.187 | 0.000 |
| −0.910 | 0.196 | 0.000 |
| −0.908 | 0.203 | 0.000 |
| −0.905 | 0.208 | 0.000 |
| −0.902 | 0.211 | 0.000 |
| −0.898 | 0.212 | 0.000 |
| −0.893 | 0.212 | 0.000 |
| −0.886 | 0.210 | 0.000 |
| −0.879 | 0.207 | 0.000 |
| −0.870 | 0.202 | 0.000 |
| −0.858 | 0.194 | 0.000 |
| −0.845 | 0.183 | 0.000 |
| −0.830 | 0.169 | 0.000 |
| −0.812 | 0.152 | 0.000 |
| −0.791 | 0.131 | 0.000 |
| −0.766 | 0.107 | 0.000 |
| −0.737 | 0.080 | 0.000 |
| −0.705 | 0.049 | 0.000 |
| −0.667 | 0.015 | 0.000 |
| −0.625 | −0.021 | 0.000 |
| −0.578 | −0.060 | 0.000 |
| −0.529 | −0.100 | 0.000 |
| −0.477 | −0.140 | 0.000 |
| −0.421 | −0.182 | 0.000 |
| −0.363 | −0.223 | 0.000 |
| −0.303 | −0.266 | 0.000 |
| −0.239 | −0.309 | 0.000 |
| −0.172 | −0.351 | 0.000 |
| −0.103 | −0.391 | 0.000 |
| −0.034 | −0.428 | 0.000 |
| 0.037 | −0.463 | 0.000 |
| 0.108 | −0.496 | 0.000 |
| 0.180 | −0.527 | 0.000 |
| 0.252 | −0.556 | 0.000 |
| 0.325 | −0.583 | 0.000 |
| 0.399 | −0.608 | 0.000 |
| 0.473 | −0.631 | 0.000 |
| 0.548 | −0.652 | 0.000 |
| 0.624 | −0.671 | 0.000 |
| 0.697 | −0.688 | 0.000 |
| 0.769 | −0.703 | 0.000 |
| 0.838 | −0.716 | 0.000 |
| 0.905 | −0.728 | 0.000 |
| 0.970 | −0.738 | 0.000 |
| 1.032 | −0.746 | 0.000 |
| 1.092 | −0.754 | 0.000 |
| 1.150 | −0.760 | 0.000 |
| 1.202 | −0.765 | 0.000 |
| 1.250 | −0.769 | 0.000 |
| 1.292 | −0.771 | 0.000 |
| 1.331 | −0.773 | 0.000 |
| 1.365 | −0.773 | 0.000 |
| 1.392 | −0.774 | 0.000 |
| 1.413 | −0.774 | 0.000 |
| 1.429 | −0.774 | 0.000 |
| 1.440 | −0.776 | 0.000 |
| 1.445 | −0.780 | 0.000 |
| 1.447 | −0.784 | 0.000 |
| 1.447 | −0.786 | 0.000 |
| 1.447 | −0.787 | 0.000 |
| 1.447 | −0.788 | 0.000 |
| 1.363 | −0.669 | 0.198 |
| 1.363 | −0.670 | 0.198 |
| 1.363 | −0.673 | 0.198 |
| 1.361 | −0.677 | 0.198 |
| 1.357 | −0.682 | 0.198 |
| 1.346 | −0.685 | 0.198 |
| 1.330 | −0.686 | 0.198 |
| 1.310 | −0.688 | 0.198 |
| 1.284 | −0.690 | 0.198 |
| 1.250 | −0.693 | 0.198 |
| 1.211 | −0.697 | 0.198 |
| 1.169 | −0.701 | 0.198 |
| 1.123 | −0.705 | 0.198 |

-continued

| X-LOC | Y-LOC | Z-LOC |
|---|---|---|
| 1.071 | −0.710 | 0.198 |
| 1.013 | −0.714 | 0.198 |
| 0.953 | −0.718 | 0.198 |
| 0.891 | −0.722 | 0.198 |
| 0.826 | −0.725 | 0.198 |
| 0.758 | −0.727 | 0.198 |
| 0.687 | −0.727 | 0.198 |
| 0.614 | −0.726 | 0.198 |
| 0.539 | −0.723 | 0.198 |
| 0.461 | −0.718 | 0.198 |
| 0.383 | −0.710 | 0.198 |
| 0.305 | −0.700 | 0.198 |
| 0.228 | −0.688 | 0.198 |
| 0.152 | −0.673 | 0.198 |
| 0.076 | −0.655 | 0.198 |
| 0.002 | −0.635 | 0.198 |
| −0.072 | −0.611 | 0.198 |
| −0.145 | −0.584 | 0.198 |
| −0.217 | −0.554 | 0.198 |
| −0.288 | −0.520 | 0.198 |
| −0.356 | −0.482 | 0.198 |
| −0.420 | −0.443 | 0.198 |
| −0.479 | −0.401 | 0.198 |
| −0.534 | −0.358 | 0.198 |
| −0.586 | −0.314 | 0.198 |
| −0.633 | −0.269 | 0.198 |
| −0.676 | −0.224 | 0.198 |
| −0.716 | −0.179 | 0.198 |
| −0.750 | −0.136 | 0.198 |
| −0.779 | −0.096 | 0.198 |
| −0.804 | −0.060 | 0.198 |
| −0.824 | −0.026 | 0.198 |
| −0.841 | 0.004 | 0.198 |
| −0.854 | 0.029 | 0.198 |
| −0.865 | 0.052 | 0.198 |
| −0.873 | 0.071 | 0.198 |
| −0.879 | 0.087 | 0.198 |
| −0.883 | 0.100 | 0.198 |
| −0.885 | 0.110 | 0.198 |
| −0.886 | 0.118 | 0.198 |
| −0.885 | 0.125 | 0.198 |
| −0.884 | 0.130 | 0.198 |
| −0.881 | 0.133 | 0.198 |
| −0.878 | 0.134 | 0.198 |
| −0.873 | 0.134 | 0.198 |
| −0.867 | 0.131 | 0.198 |
| −0.861 | 0.128 | 0.198 |
| −0.852 | 0.123 | 0.198 |
| −0.842 | 0.115 | 0.198 |
| −0.830 | 0.104 | 0.198 |
| −0.816 | 0.091 | 0.198 |
| −0.799 | 0.075 | 0.198 |
| −0.779 | 0.056 | 0.198 |
| −0.756 | 0.035 | 0.198 |
| −0.728 | 0.010 | 0.198 |
| −0.696 | −0.017 | 0.198 |
| −0.660 | −0.047 | 0.198 |
| −0.619 | −0.078 | 0.198 |
| −0.573 | −0.112 | 0.198 |
| −0.525 | −0.146 | 0.198 |
| −0.474 | −0.180 | 0.198 |
| −0.420 | −0.214 | 0.198 |
| −0.362 | −0.248 | 0.198 |
| −0.303 | −0.282 | 0.198 |
| −0.240 | −0.315 | 0.198 |
| −0.174 | −0.348 | 0.198 |
| −0.107 | −0.379 | 0.198 |
| −0.039 | −0.407 | 0.198 |
| 0.030 | −0.433 | 0.198 |
| 0.099 | −0.458 | 0.198 |
| 0.168 | −0.480 | 0.198 |
| 0.238 | −0.501 | 0.198 |
| 0.308 | −0.521 | 0.198 |
| 0.379 | −0.539 | 0.198 |
| 0.450 | −0.556 | 0.198 |
| 0.521 | −0.571 | 0.198 |
| 0.592 | −0.586 | 0.198 |

-continued

| X-LOC | Y-LOC | Z-LOC |
|---|---|---|
| 0.662 | −0.598 | 0.198 |
| 0.729 | −0.609 | 0.198 |
| 0.794 | −0.618 | 0.198 |
| 0.857 | −0.626 | 0.198 |
| 0.918 | −0.633 | 0.198 |
| 0.977 | −0.639 | 0.198 |
| 1.033 | −0.644 | 0.198 |
| 1.087 | −0.648 | 0.198 |
| 1.136 | −0.651 | 0.198 |
| 1.180 | −0.653 | 0.198 |
| 1.219 | −0.654 | 0.198 |
| 1.256 | −0.655 | 0.198 |
| 1.287 | −0.655 | 0.198 |
| 1.312 | −0.655 | 0.198 |
| 1.332 | −0.655 | 0.198 |
| 1.346 | −0.655 | 0.198 |
| 1.357 | −0.657 | 0.198 |
| 1.361 | −0.662 | 0.198 |
| 1.362 | −0.665 | 0.198 |
| 1.363 | −0.667 | 0.198 |
| 1.363 | −0.668 | 0.198 |
| 1.363 | −0.669 | 0.198 |
| 1.297 | −0.590 | 0.346 |
| 1.297 | −0.591 | 0.346 |
| 1.297 | −0.593 | 0.346 |
| 1.296 | −0.597 | 0.346 |
| 1.292 | −0.602 | 0.346 |
| 1.282 | −0.605 | 0.346 |
| 1.267 | −0.607 | 0.346 |
| 1.248 | −0.608 | 0.346 |
| 1.223 | −0.610 | 0.346 |
| 1.192 | −0.612 | 0.346 |
| 1.156 | −0.615 | 0.346 |
| 1.117 | −0.618 | 0.346 |
| 1.073 | −0.621 | 0.346 |
| 1.024 | −0.624 | 0.346 |
| 0.971 | −0.628 | 0.346 |
| 0.915 | −0.630 | 0.346 |
| 0.857 | −0.633 | 0.346 |
| 0.796 | −0.634 | 0.346 |
| 0.733 | −0.635 | 0.346 |
| 0.667 | −0.635 | 0.346 |
| 0.599 | −0.633 | 0.346 |
| 0.528 | −0.630 | 0.346 |
| 0.456 | −0.625 | 0.346 |
| 0.383 | −0.619 | 0.346 |
| 0.310 | −0.611 | 0.346 |
| 0.238 | −0.601 | 0.346 |
| 0.166 | −0.589 | 0.346 |
| 0.095 | −0.574 | 0.346 |
| 0.024 | −0.558 | 0.346 |
| −0.046 | −0.539 | 0.346 |
| −0.115 | −0.518 | 0.346 |
| −0.183 | −0.494 | 0.346 |
| −0.250 | −0.466 | 0.346 |
| −0.317 | −0.436 | 0.346 |
| −0.379 | −0.403 | 0.346 |
| −0.438 | −0.368 | 0.346 |
| −0.493 | −0.332 | 0.346 |
| −0.544 | −0.295 | 0.346 |
| −0.591 | −0.258 | 0.346 |
| −0.635 | −0.220 | 0.346 |
| −0.676 | −0.181 | 0.346 |
| −0.712 | −0.144 | 0.346 |
| −0.743 | −0.110 | 0.346 |
| −0.769 | −0.078 | 0.346 |
| −0.791 | −0.049 | 0.346 |
| −0.809 | −0.023 | 0.346 |
| −0.824 | 0.000 | 0.346 |
| −0.836 | 0.019 | 0.346 |
| −0.846 | 0.036 | 0.346 |
| −0.854 | 0.050 | 0.346 |
| −0.859 | 0.062 | 0.346 |
| −0.863 | 0.071 | 0.346 |
| −0.865 | 0.078 | 0.346 |
| −0.866 | 0.084 | 0.346 |
| −0.865 | 0.089 | 0.346 |

-continued

| X-LOC | Y-LOC | Z-LOC |
|---|---|---|
| −0.863 | 0.092 | 0.346 |
| −0.860 | 0.093 | 0.346 |
| −0.855 | 0.092 | 0.346 |
| −0.850 | 0.090 | 0.346 |
| −0.844 | 0.086 | 0.346 |
| −0.836 | 0.081 | 0.346 |
| −0.827 | 0.073 | 0.346 |
| −0.815 | 0.062 | 0.346 |
| −0.802 | 0.050 | 0.346 |
| −0.785 | 0.035 | 0.346 |
| −0.766 | 0.017 | 0.346 |
| −0.743 | −0.003 | 0.346 |
| −0.716 | −0.026 | 0.346 |
| −0.685 | −0.051 | 0.346 |
| −0.650 | −0.079 | 0.346 |
| −0.610 | −0.108 | 0.346 |
| −0.565 | −0.139 | 0.346 |
| −0.518 | −0.170 | 0.346 |
| −0.468 | −0.201 | 0.346 |
| −0.414 | −0.231 | 0.346 |
| −0.358 | −0.261 | 0.346 |
| −0.299 | −0.290 | 0.346 |
| −0.237 | −0.319 | 0.346 |
| −0.173 | −0.347 | 0.346 |
| −0.108 | −0.372 | 0.346 |
| −0.043 | −0.395 | 0.346 |
| 0.023 | −0.416 | 0.346 |
| 0.089 | −0.435 | 0.346 |
| 0.156 | −0.452 | 0.346 |
| 0.223 | −0.469 | 0.346 |
| 0.290 | −0.484 | 0.346 |
| 0.358 | −0.498 | 0.346 |
| 0.426 | −0.510 | 0.346 |
| 0.494 | −0.522 | 0.346 |
| 0.563 | −0.533 | 0.346 |
| 0.629 | −0.542 | 0.346 |
| 0.693 | −0.549 | 0.346 |
| 0.756 | −0.556 | 0.346 |
| 0.816 | −0.561 | 0.346 |
| 0.874 | −0.566 | 0.346 |
| 0.930 | −0.570 | 0.346 |
| 0.983 | −0.572 | 0.346 |
| 1.034 | −0.575 | 0.346 |
| 1.081 | −0.576 | 0.346 |
| 1.123 | −0.577 | 0.346 |
| 1.160 | −0.577 | 0.346 |
| 1.195 | −0.577 | 0.346 |
| 1.226 | −0.577 | 0.346 |
| 1.249 | −0.576 | 0.346 |
| 1.268 | −0.576 | 0.346 |
| 1.282 | −0.576 | 0.346 |
| 1.291 | −0.579 | 0.346 |
| 1.295 | −0.583 | 0.346 |
| 1.296 | −0.587 | 0.346 |
| 1.297 | −0.588 | 0.346 |
| 1.297 | −0.589 | 0.346 |
| 1.297 | −0.590 | 0.346 |
| 1.237 | −0.541 | 0.493 |
| 1.237 | −0.542 | 0.493 |
| 1.237 | −0.544 | 0.493 |
| 1.236 | −0.547 | 0.493 |
| 1.233 | −0.552 | 0.493 |
| 1.223 | −0.556 | 0.493 |
| 1.209 | −0.557 | 0.493 |
| 1.191 | −0.558 | 0.493 |
| 1.168 | −0.560 | 0.493 |
| 1.138 | −0.562 | 0.493 |
| 1.103 | −0.565 | 0.493 |
| 1.066 | −0.568 | 0.493 |
| 1.025 | −0.571 | 0.493 |
| 0.979 | −0.574 | 0.493 |
| 0.928 | −0.577 | 0.493 |
| 0.875 | −0.579 | 0.493 |
| 0.819 | −0.581 | 0.493 |
| 0.762 | −0.583 | 0.493 |
| 0.702 | −0.583 | 0.493 |
| 0.639 | −0.583 | 0.493 |

-continued

| X-LOC | Y-LOC | Z-LOC |
|---|---|---|
| 0.574 | −0.582 | 0.493 |
| 0.507 | −0.579 | 0.493 |
| 0.438 | −0.575 | 0.493 |
| 0.369 | −0.569 | 0.493 |
| 0.301 | −0.562 | 0.493 |
| 0.232 | −0.553 | 0.493 |
| 0.164 | −0.543 | 0.493 |
| 0.095 | −0.530 | 0.493 |
| 0.028 | −0.516 | 0.493 |
| −0.040 | −0.499 | 0.493 |
| −0.106 | −0.480 | 0.493 |
| −0.171 | −0.459 | 0.493 |
| −0.236 | −0.435 | 0.493 |
| −0.299 | −0.408 | 0.493 |
| −0.359 | −0.380 | 0.493 |
| −0.416 | −0.349 | 0.493 |
| −0.470 | −0.317 | 0.493 |
| −0.520 | −0.284 | 0.493 |
| −0.567 | −0.250 | 0.493 |
| −0.610 | −0.216 | 0.493 |
| −0.650 | −0.181 | 0.493 |
| −0.686 | −0.147 | 0.493 |
| −0.716 | −0.116 | 0.493 |
| −0.743 | −0.087 | 0.493 |
| −0.765 | −0.060 | 0.493 |
| −0.784 | −0.036 | 0.493 |
| −0.799 | −0.016 | 0.493 |
| −0.812 | 0.002 | 0.493 |
| −0.822 | 0.018 | 0.493 |
| −0.830 | 0.030 | 0.493 |
| −0.836 | 0.041 | 0.493 |
| −0.840 | 0.049 | 0.493 |
| −0.842 | 0.056 | 0.493 |
| −0.843 | 0.062 | 0.493 |
| −0.843 | 0.066 | 0.493 |
| −0.841 | 0.069 | 0.493 |
| −0.838 | 0.070 | 0.493 |
| −0.834 | 0.070 | 0.493 |
| −0.829 | 0.068 | 0.493 |
| −0.823 | 0.064 | 0.493 |
| −0.816 | 0.059 | 0.493 |
| −0.807 | 0.051 | 0.493 |
| −0.796 | 0.042 | 0.493 |
| −0.782 | 0.030 | 0.493 |
| −0.767 | 0.016 | 0.493 |
| −0.748 | 0.000 | 0.493 |
| −0.726 | −0.019 | 0.493 |
| −0.700 | −0.041 | 0.493 |
| −0.670 | −0.064 | 0.493 |
| −0.636 | −0.090 | 0.493 |
| −0.598 | −0.117 | 0.493 |
| −0.555 | −0.146 | 0.493 |
| −0.510 | −0.175 | 0.493 |
| −0.461 | −0.203 | 0.493 |
| −0.410 | −0.231 | 0.493 |
| −0.356 | −0.258 | 0.493 |
| −0.300 | −0.284 | 0.493 |
| −0.240 | −0.310 | 0.493 |
| −0.178 | −0.335 | 0.493 |
| −0.115 | −0.358 | 0.493 |
| −0.051 | −0.378 | 0.493 |
| 0.013 | −0.397 | 0.493 |
| 0.077 | −0.415 | 0.493 |
| 0.142 | −0.430 | 0.493 |
| 0.207 | −0.445 | 0.493 |
| 0.272 | −0.458 | 0.493 |
| 0.337 | −0.470 | 0.493 |
| 0.403 | −0.480 | 0.493 |
| 0.468 | −0.490 | 0.493 |
| 0.534 | −0.498 | 0.493 |
| 0.598 | −0.506 | 0.493 |
| 0.660 | −0.512 | 0.493 |
| 0.719 | −0.517 | 0.493 |
| 0.777 | −0.521 | 0.493 |
| 0.833 | −0.524 | 0.493 |
| 0.886 | −0.526 | 0.493 |
| 0.937 | −0.528 | 0.493 |

-continued

| X-LOC | Y-LOC | Z-LOC |
|---|---|---|
| 0.986 | −0.529 | 0.493 |
| 1.031 | −0.529 | 0.493 |
| 1.071 | −0.529 | 0.493 |
| 1.107 | −0.529 | 0.493 |
| 1.140 | −0.529 | 0.493 |
| 1.169 | −0.528 | 0.493 |
| 1.191 | −0.527 | 0.493 |
| 1.209 | −0.527 | 0.493 |
| 1.223 | −0.526 | 0.493 |
| 1.232 | −0.530 | 0.493 |
| 1.235 | −0.534 | 0.493 |
| 1.237 | −0.537 | 0.493 |
| 1.237 | −0.539 | 0.493 |
| 1.237 | −0.540 | 0.493 |
| 1.237 | −0.540 | 0.493 |
| 1.196 | −0.518 | 0.641 |
| 1.196 | −0.519 | 0.641 |
| 1.196 | −0.521 | 0.641 |
| 1.195 | −0.524 | 0.641 |
| 1.192 | −0.529 | 0.641 |
| 1.183 | −0.534 | 0.641 |
| 1.170 | −0.535 | 0.641 |
| 1.152 | −0.536 | 0.641 |
| 1.130 | −0.538 | 0.641 |
| 1.101 | −0.541 | 0.641 |
| 1.067 | −0.544 | 0.641 |
| 1.031 | −0.547 | 0.641 |
| 0.991 | −0.551 | 0.641 |
| 0.946 | −0.554 | 0.641 |
| 0.897 | −0.558 | 0.641 |
| 0.846 | −0.561 | 0.641 |
| 0.792 | −0.564 | 0.641 |
| 0.736 | −0.567 | 0.641 |
| 0.678 | −0.568 | 0.641 |
| 0.617 | −0.569 | 0.641 |
| 0.554 | −0.568 | 0.641 |
| 0.489 | −0.566 | 0.641 |
| 0.422 | −0.563 | 0.641 |
| 0.355 | −0.558 | 0.641 |
| 0.288 | −0.552 | 0.641 |
| 0.222 | −0.544 | 0.641 |
| 0.155 | −0.534 | 0.641 |
| 0.089 | −0.522 | 0.641 |
| 0.024 | −0.508 | 0.641 |
| −0.041 | −0.492 | 0.641 |
| −0.105 | −0.474 | 0.641 |
| −0.169 | −0.454 | 0.641 |
| −0.231 | −0.431 | 0.641 |
| −0.293 | −0.405 | 0.641 |
| −0.352 | −0.377 | 0.641 |
| −0.408 | −0.348 | 0.641 |
| −0.460 | −0.317 | 0.641 |
| −0.508 | −0.285 | 0.641 |
| −0.553 | −0.252 | 0.641 |
| −0.595 | −0.219 | 0.641 |
| −0.634 | −0.185 | 0.641 |
| −0.668 | −0.153 | 0.641 |
| −0.698 | −0.122 | 0.641 |
| −0.724 | −0.094 | 0.641 |
| −0.746 | −0.069 | 0.641 |
| −0.764 | −0.046 | 0.641 |
| −0.779 | −0.026 | 0.641 |
| −0.791 | −0.008 | 0.641 |
| −0.801 | 0.006 | 0.641 |
| −0.809 | 0.019 | 0.641 |
| −0.815 | 0.029 | 0.641 |
| −0.819 | 0.037 | 0.641 |
| −0.821 | 0.044 | 0.641 |
| −0.822 | 0.049 | 0.641 |
| −0.822 | 0.054 | 0.641 |
| −0.820 | 0.057 | 0.641 |
| −0.817 | 0.058 | 0.641 |
| −0.812 | 0.057 | 0.641 |
| −0.807 | 0.055 | 0.641 |
| −0.802 | 0.052 | 0.641 |
| −0.795 | 0.047 | 0.641 |
| −0.786 | 0.040 | 0.641 |

-continued

| X-LOC | Y-LOC | Z-LOC |
|---|---|---|
| −0.775 | 0.031 | 0.641 |
| −0.762 | 0.020 | 0.641 |
| −0.746 | 0.007 | 0.641 |
| −0.728 | −0.008 | 0.641 |
| −0.706 | −0.026 | 0.641 |
| −0.680 | −0.046 | 0.641 |
| −0.651 | −0.069 | 0.641 |
| −0.617 | −0.093 | 0.641 |
| −0.580 | −0.119 | 0.641 |
| −0.538 | −0.147 | 0.641 |
| −0.494 | −0.174 | 0.641 |
| −0.446 | −0.201 | 0.641 |
| −0.397 | −0.227 | 0.641 |
| −0.344 | −0.253 | 0.641 |
| −0.289 | −0.278 | 0.641 |
| −0.231 | −0.303 | 0.641 |
| −0.171 | −0.326 | 0.641 |
| −0.110 | −0.348 | 0.641 |
| −0.049 | −0.367 | 0.641 |
| 0.012 | −0.386 | 0.641 |
| 0.074 | −0.402 | 0.641 |
| 0.136 | −0.417 | 0.641 |
| 0.198 | −0.431 | 0.641 |
| 0.261 | −0.444 | 0.641 |
| 0.324 | −0.455 | 0.641 |
| 0.387 | −0.465 | 0.641 |
| 0.451 | −0.474 | 0.641 |
| 0.515 | −0.482 | 0.641 |
| 0.577 | −0.488 | 0.641 |
| 0.637 | −0.494 | 0.641 |
| 0.695 | −0.498 | 0.641 |
| 0.751 | −0.502 | 0.641 |
| 0.805 | −0.505 | 0.641 |
| 0.857 | −0.507 | 0.641 |
| 0.906 | −0.508 | 0.641 |
| 0.954 | −0.508 | 0.641 |
| 0.997 | −0.508 | 0.641 |
| 1.036 | −0.508 | 0.641 |
| 1.070 | −0.508 | 0.641 |
| 1.102 | −0.507 | 0.641 |
| 1.130 | −0.506 | 0.641 |
| 1.152 | −0.505 | 0.641 |
| 1.169 | −0.504 | 0.641 |
| 1.182 | −0.504 | 0.641 |
| 1.191 | −0.507 | 0.641 |
| 1.195 | −0.511 | 0.641 |
| 1.196 | −0.515 | 0.641 |
| 1.196 | −0.516 | 0.641 |
| 1.196 | −0.517 | 0.641 |
| 1.196 | −0.518 | 0.641 |
| 1.185 | −0.516 | 0.789 |
| 1.185 | −0.517 | 0.789 |
| 1.185 | −0.519 | 0.789 |
| 1.184 | −0.522 | 0.789 |
| 1.181 | −0.527 | 0.789 |
| 1.172 | −0.532 | 0.789 |
| 1.159 | −0.533 | 0.789 |
| 1.142 | −0.535 | 0.789 |
| 1.119 | −0.537 | 0.789 |
| 1.091 | −0.540 | 0.789 |
| 1.058 | −0.543 | 0.789 |
| 1.022 | −0.547 | 0.789 |
| 0.983 | −0.551 | 0.789 |
| 0.939 | −0.555 | 0.789 |
| 0.890 | −0.559 | 0.789 |
| 0.839 | −0.563 | 0.789 |
| 0.786 | −0.566 | 0.789 |
| 0.731 | −0.569 | 0.789 |
| 0.673 | −0.571 | 0.789 |
| 0.614 | −0.572 | 0.789 |
| 0.552 | −0.572 | 0.789 |
| 0.487 | −0.571 | 0.789 |
| 0.421 | −0.568 | 0.789 |
| 0.355 | −0.564 | 0.789 |
| 0.289 | −0.557 | 0.789 |
| 0.223 | −0.550 | 0.789 |
| 0.157 | −0.540 | 0.789 |

-continued

| X-LOC | Y-LOC | Z-LOC |
|---|---|---|
| 0.092 | −0.528 | 0.789 |
| 0.028 | −0.514 | 0.789 |
| −0.036 | −0.498 | 0.789 |
| −0.099 | −0.480 | 0.789 |
| −0.162 | −0.459 | 0.789 |
| −0.224 | −0.436 | 0.789 |
| −0.285 | −0.410 | 0.789 |
| −0.343 | −0.382 | 0.789 |
| −0.397 | −0.352 | 0.789 |
| −0.448 | −0.321 | 0.789 |
| −0.495 | −0.290 | 0.789 |
| −0.540 | −0.257 | 0.789 |
| −0.581 | −0.224 | 0.789 |
| −0.619 | −0.190 | 0.789 |
| −0.653 | −0.158 | 0.789 |
| −0.682 | −0.128 | 0.789 |
| −0.708 | −0.100 | 0.789 |
| −0.729 | −0.074 | 0.789 |
| −0.747 | −0.051 | 0.789 |
| −0.761 | −0.032 | 0.789 |
| −0.773 | −0.014 | 0.789 |
| −0.783 | 0.000 | 0.789 |
| −0.791 | 0.013 | 0.789 |
| −0.796 | 0.023 | 0.789 |
| −0.800 | 0.031 | 0.789 |
| −0.802 | 0.037 | 0.789 |
| −0.803 | 0.043 | 0.789 |
| −0.803 | 0.047 | 0.789 |
| −0.801 | 0.050 | 0.789 |
| −0.798 | 0.051 | 0.789 |
| −0.794 | 0.051 | 0.789 |
| −0.788 | 0.049 | 0.789 |
| −0.783 | 0.046 | 0.789 |
| −0.776 | 0.041 | 0.789 |
| −0.767 | 0.035 | 0.789 |
| −0.756 | 0.026 | 0.789 |
| −0.743 | 0.015 | 0.789 |
| −0.727 | 0.002 | 0.789 |
| −0.709 | −0.013 | 0.789 |
| −0.688 | −0.030 | 0.789 |
| −0.662 | −0.050 | 0.789 |
| −0.633 | −0.072 | 0.789 |
| −0.600 | −0.096 | 0.789 |
| −0.563 | −0.122 | 0.789 |
| −0.522 | −0.149 | 0.789 |
| −0.479 | −0.176 | 0.789 |
| −0.432 | −0.203 | 0.789 |
| −0.383 | −0.229 | 0.789 |
| −0.331 | −0.255 | 0.789 |
| −0.277 | −0.280 | 0.789 |
| −0.220 | −0.305 | 0.789 |
| −0.161 | −0.328 | 0.789 |
| −0.102 | −0.350 | 0.789 |
| −0.042 | −0.369 | 0.789 |
| 0.019 | −0.388 | 0.789 |
| 0.079 | −0.404 | 0.789 |
| 0.140 | −0.419 | 0.789 |
| 0.202 | −0.433 | 0.789 |
| 0.264 | −0.445 | 0.789 |
| 0.326 | −0.457 | 0.789 |
| 0.388 | −0.467 | 0.789 |
| 0.451 | −0.475 | 0.789 |
| 0.513 | −0.483 | 0.789 |
| 0.574 | −0.490 | 0.789 |
| 0.634 | −0.495 | 0.789 |
| 0.691 | −0.499 | 0.789 |
| 0.746 | −0.502 | 0.789 |
| 0.799 | −0.505 | 0.789 |
| 0.850 | −0.506 | 0.789 |
| 0.899 | −0.507 | 0.789 |
| 0.946 | −0.508 | 0.789 |
| 0.988 | −0.508 | 0.789 |
| 1.026 | −0.507 | 0.789 |
| 1.060 | −0.506 | 0.789 |
| 1.092 | −0.505 | 0.789 |
| 1.120 | −0.504 | 0.789 |
| 1.141 | −0.503 | 0.789 |

-continued

| X-LOC | Y-LOC | Z-LOC |
|---|---|---|
| 1.158 | −0.502 | 0.789 |
| 1.171 | −0.502 | 0.789 |
| 1.180 | −0.505 | 0.789 |
| 1.183 | −0.510 | 0.789 |
| 1.184 | −0.513 | 0.789 |
| 1.185 | −0.514 | 0.789 |
| 1.185 | −0.515 | 0.789 |
| 1.185 | −0.516 | 0.789 |
| 1.199 | −0.532 | 0.936 |
| 1.199 | −0.533 | 0.936 |
| 1.199 | −0.535 | 0.936 |
| 1.198 | −0.539 | 0.936 |
| 1.196 | −0.543 | 0.936 |
| 1.187 | −0.548 | 0.936 |
| 1.174 | −0.549 | 0.936 |
| 1.156 | −0.551 | 0.936 |
| 1.134 | −0.553 | 0.936 |
| 1.105 | −0.556 | 0.936 |
| 1.072 | −0.560 | 0.936 |
| 1.036 | −0.564 | 0.936 |
| 0.997 | −0.568 | 0.936 |
| 0.952 | −0.572 | 0.936 |
| 0.903 | −0.576 | 0.936 |
| 0.852 | −0.580 | 0.936 |
| 0.799 | −0.584 | 0.936 |
| 0.744 | −0.587 | 0.936 |
| 0.686 | −0.589 | 0.936 |
| 0.626 | −0.590 | 0.936 |
| 0.564 | −0.590 | 0.936 |
| 0.499 | −0.588 | 0.936 |
| 0.432 | −0.585 | 0.936 |
| 0.366 | −0.580 | 0.936 |
| 0.300 | −0.574 | 0.936 |
| 0.233 | −0.565 | 0.936 |
| 0.168 | −0.555 | 0.936 |
| 0.102 | −0.543 | 0.936 |
| 0.038 | −0.528 | 0.936 |
| −0.026 | −0.511 | 0.936 |
| −0.089 | −0.492 | 0.936 |
| −0.152 | −0.470 | 0.936 |
| −0.214 | −0.446 | 0.936 |
| −0.274 | −0.419 | 0.936 |
| −0.332 | −0.390 | 0.936 |
| −0.386 | −0.359 | 0.936 |
| −0.437 | −0.327 | 0.936 |
| −0.484 | −0.295 | 0.936 |
| −0.528 | −0.261 | 0.936 |
| −0.569 | −0.227 | 0.936 |
| −0.606 | −0.193 | 0.936 |
| −0.640 | −0.160 | 0.936 |
| −0.669 | −0.129 | 0.936 |
| −0.694 | −0.100 | 0.936 |
| −0.715 | −0.075 | 0.936 |
| −0.733 | −0.052 | 0.936 |
| −0.747 | −0.032 | 0.936 |
| −0.759 | −0.014 | 0.936 |
| −0.768 | 0.001 | 0.936 |
| −0.776 | 0.013 | 0.936 |
| −0.781 | 0.024 | 0.936 |
| −0.785 | 0.032 | 0.936 |
| −0.787 | 0.038 | 0.936 |
| −0.788 | 0.044 | 0.936 |
| −0.788 | 0.048 | 0.936 |
| −0.786 | 0.051 | 0.936 |
| −0.783 | 0.052 | 0.936 |
| −0.779 | 0.052 | 0.936 |
| −0.774 | 0.050 | 0.936 |
| −0.768 | 0.047 | 0.936 |
| −0.761 | 0.042 | 0.936 |
| −0.752 | 0.035 | 0.936 |
| −0.741 | 0.026 | 0.936 |
| −0.728 | 0.015 | 0.936 |
| −0.713 | 0.001 | 0.936 |
| −0.695 | −0.014 | 0.936 |
| −0.674 | −0.032 | 0.936 |
| −0.649 | −0.053 | 0.936 |
| −0.620 | −0.075 | 0.936 |

-continued

| X-LOC | Y-LOC | Z-LOC |
|---|---|---|
| −0.587 | −0.100 | 0.936 |
| −0.551 | −0.126 | 0.936 |
| −0.510 | −0.154 | 0.936 |
| −0.466 | −0.182 | 0.936 |
| −0.420 | −0.210 | 0.936 |
| −0.372 | −0.238 | 0.936 |
| −0.320 | −0.264 | 0.936 |
| −0.266 | −0.291 | 0.936 |
| −0.209 | −0.316 | 0.936 |
| −0.150 | −0.340 | 0.936 |
| −0.091 | −0.363 | 0.936 |
| −0.031 | −0.384 | 0.936 |
| 0.030 | −0.403 | 0.936 |
| 0.091 | −0.420 | 0.936 |
| 0.152 | −0.436 | 0.936 |
| 0.213 | −0.450 | 0.936 |
| 0.275 | −0.463 | 0.936 |
| 0.337 | −0.474 | 0.936 |
| 0.400 | −0.485 | 0.936 |
| 0.462 | −0.494 | 0.936 |
| 0.525 | −0.502 | 0.936 |
| 0.587 | −0.508 | 0.936 |
| 0.646 | −0.513 | 0.936 |
| 0.703 | −0.517 | 0.936 |
| 0.759 | −0.521 | 0.936 |
| 0.812 | −0.523 | 0.936 |
| 0.863 | −0.524 | 0.936 |
| 0.912 | −0.525 | 0.936 |
| 0.959 | −0.525 | 0.936 |
| 1.002 | −0.525 | 0.936 |
| 1.040 | −0.524 | 0.936 |
| 1.074 | −0.523 | 0.936 |
| 1.106 | −0.522 | 0.936 |
| 1.134 | −0.521 | 0.936 |
| 1.155 | −0.520 | 0.936 |
| 1.173 | −0.519 | 0.936 |
| 1.185 | −0.518 | 0.936 |
| 1.194 | −0.522 | 0.936 |
| 1.198 | −0.526 | 0.936 |
| 1.199 | −0.529 | 0.936 |
| 1.199 | −0.531 | 0.936 |
| 1.199 | −0.532 | 0.936 |
| 1.199 | −0.532 | 0.936 |
| 1.231 | −0.567 | 1.084 |
| 1.231 | −0.568 | 1.084 |
| 1.231 | −0.570 | 1.084 |
| 1.230 | −0.573 | 1.084 |
| 1.227 | −0.578 | 1.084 |
| 1.218 | −0.583 | 1.084 |
| 1.205 | −0.584 | 1.084 |
| 1.187 | −0.586 | 1.084 |
| 1.164 | −0.588 | 1.084 |
| 1.135 | −0.591 | 1.084 |
| 1.101 | −0.595 | 1.084 |
| 1.065 | −0.598 | 1.084 |
| 1.025 | −0.602 | 1.084 |
| 0.980 | −0.607 | 1.084 |
| 0.930 | −0.611 | 1.084 |
| 0.878 | −0.614 | 1.084 |
| 0.824 | −0.617 | 1.084 |
| 0.768 | −0.620 | 1.084 |
| 0.709 | −0.621 | 1.084 |
| 0.648 | −0.621 | 1.084 |
| 0.585 | −0.620 | 1.084 |
| 0.520 | −0.618 | 1.084 |
| 0.453 | −0.614 | 1.084 |
| 0.386 | −0.608 | 1.084 |
| 0.319 | −0.601 | 1.084 |
| 0.252 | −0.591 | 1.084 |
| 0.186 | −0.580 | 1.084 |
| 0.120 | −0.566 | 1.084 |
| 0.054 | −0.550 | 1.084 |
| −0.011 | −0.531 | 1.084 |
| −0.076 | −0.510 | 1.084 |
| −0.139 | −0.486 | 1.084 |
| −0.201 | −0.460 | 1.084 |
| −0.262 | −0.431 | 1.084 |

-continued

| X-LOC | Y-LOC | Z-LOC |
|---|---|---|
| −0.320 | −0.400 | 1.084 |
| −0.375 | −0.367 | 1.084 |
| −0.426 | −0.333 | 1.084 |
| −0.473 | −0.298 | 1.084 |
| −0.517 | −0.263 | 1.084 |
| −0.558 | −0.227 | 1.084 |
| −0.595 | −0.191 | 1.084 |
| −0.629 | −0.157 | 1.084 |
| −0.657 | −0.125 | 1.084 |
| −0.682 | −0.095 | 1.084 |
| −0.703 | −0.068 | 1.084 |
| −0.721 | −0.044 | 1.084 |
| −0.735 | −0.024 | 1.084 |
| −0.747 | −0.006 | 1.084 |
| −0.756 | 0.010 | 1.084 |
| −0.763 | 0.022 | 1.084 |
| −0.769 | 0.033 | 1.084 |
| −0.773 | 0.041 | 1.084 |
| −0.775 | 0.048 | 1.084 |
| −0.776 | 0.053 | 1.084 |
| −0.775 | 0.058 | 1.084 |
| −0.773 | 0.061 | 1.084 |
| −0.770 | 0.062 | 1.084 |
| −0.766 | 0.061 | 1.084 |
| −0.761 | 0.059 | 1.084 |
| −0.755 | 0.055 | 1.084 |
| −0.749 | 0.050 | 1.084 |
| −0.740 | 0.042 | 1.084 |
| −0.730 | 0.033 | 1.084 |
| −0.717 | 0.021 | 1.084 |
| −0.702 | 0.007 | 1.084 |
| −0.685 | −0.010 | 1.084 |
| −0.664 | −0.029 | 1.084 |
| −0.639 | −0.051 | 1.084 |
| −0.611 | −0.075 | 1.084 |
| −0.579 | −0.101 | 1.084 |
| −0.543 | −0.130 | 1.084 |
| −0.502 | −0.160 | 1.084 |
| −0.459 | −0.190 | 1.084 |
| −0.414 | −0.220 | 1.084 |
| −0.365 | −0.249 | 1.084 |
| −0.314 | −0.278 | 1.084 |
| −0.260 | −0.307 | 1.084 |
| −0.203 | −0.334 | 1.084 |
| −0.144 | −0.361 | 1.084 |
| −0.083 | −0.386 | 1.084 |
| −0.022 | −0.408 | 1.084 |
| 0.040 | −0.429 | 1.084 |
| 0.102 | −0.448 | 1.084 |
| 0.164 | −0.465 | 1.084 |
| 0.227 | −0.481 | 1.084 |
| 0.290 | −0.495 | 1.084 |
| 0.354 | −0.507 | 1.084 |
| 0.417 | −0.518 | 1.084 |
| 0.481 | −0.528 | 1.084 |
| 0.545 | −0.536 | 1.084 |
| 0.607 | −0.543 | 1.084 |
| 0.668 | −0.549 | 1.084 |
| 0.726 | −0.553 | 1.084 |
| 0.782 | −0.556 | 1.084 |
| 0.837 | −0.559 | 1.084 |
| 0.889 | −0.560 | 1.084 |
| 0.939 | −0.561 | 1.084 |
| 0.987 | −0.561 | 1.084 |
| 1.030 | −0.560 | 1.084 |
| 1.069 | −0.559 | 1.084 |
| 1.104 | −0.558 | 1.084 |
| 1.136 | −0.557 | 1.084 |
| 1.165 | −0.556 | 1.084 |
| 1.186 | −0.554 | 1.084 |
| 1.204 | −0.553 | 1.084 |
| 1.217 | −0.553 | 1.084 |
| 1.226 | −0.556 | 1.084 |
| 1.229 | −0.560 | 1.084 |
| 1.231 | −0.564 | 1.084 |
| 1.231 | −0.565 | 1.084 |
| 1.231 | −0.566 | 1.084 |

-continued

| X-LOC | Y-LOC | Z-LOC |
|---|---|---|
| 1.231 | −0.567 | 1.084 |
| 1.275 | −0.612 | 1.231 |
| 1.275 | −0.613 | 1.231 |
| 1.275 | −0.615 | 1.231 |
| 1.274 | −0.618 | 1.231 |
| 1.271 | −0.623 | 1.231 |
| 1.262 | −0.628 | 1.231 |
| 1.248 | −0.629 | 1.231 |
| 1.229 | −0.631 | 1.231 |
| 1.206 | −0.634 | 1.231 |
| 1.176 | −0.637 | 1.231 |
| 1.141 | −0.641 | 1.231 |
| 1.104 | −0.644 | 1.231 |
| 1.063 | −0.648 | 1.231 |
| 1.016 | −0.652 | 1.231 |
| 0.965 | −0.656 | 1.231 |
| 0.912 | −0.659 | 1.231 |
| 0.856 | −0.662 | 1.231 |
| 0.798 | −0.664 | 1.231 |
| 0.738 | −0.664 | 1.231 |
| 0.675 | −0.664 | 1.231 |
| 0.611 | −0.662 | 1.231 |
| 0.544 | −0.658 | 1.231 |
| 0.475 | −0.652 | 1.231 |
| 0.406 | −0.645 | 1.231 |
| 0.338 | −0.636 | 1.231 |
| 0.270 | −0.624 | 1.231 |
| 0.202 | −0.611 | 1.231 |
| 0.134 | −0.595 | 1.231 |
| 0.066 | −0.576 | 1.231 |
| 0.000 | −0.555 | 1.231 |
| −0.065 | −0.531 | 1.231 |
| −0.130 | −0.504 | 1.231 |
| −0.193 | −0.475 | 1.231 |
| −0.254 | −0.442 | 1.231 |
| −0.312 | −0.408 | 1.231 |
| −0.367 | −0.372 | 1.231 |
| −0.418 | −0.335 | 1.231 |
| −0.465 | −0.297 | 1.231 |
| −0.508 | −0.259 | 1.231 |
| −0.548 | −0.221 | 1.231 |
| −0.585 | −0.183 | 1.231 |
| −0.618 | −0.147 | 1.231 |
| −0.646 | −0.113 | 1.231 |
| −0.671 | −0.081 | 1.231 |
| −0.692 | −0.053 | 1.231 |
| −0.709 | −0.028 | 1.231 |
| −0.722 | −0.006 | 1.231 |
| −0.734 | 0.013 | 1.231 |
| −0.743 | 0.029 | 1.231 |
| −0.750 | 0.042 | 1.231 |
| −0.756 | 0.053 | 1.231 |
| −0.759 | 0.062 | 1.231 |
| −0.761 | 0.068 | 1.231 |
| −0.762 | 0.074 | 1.231 |
| −0.762 | 0.079 | 1.231 |
| −0.760 | 0.082 | 1.231 |
| −0.756 | 0.083 | 1.231 |
| −0.752 | 0.082 | 1.231 |
| −0.747 | 0.079 | 1.231 |
| −0.742 | 0.075 | 1.231 |
| −0.735 | 0.069 | 1.231 |
| −0.727 | 0.061 | 1.231 |
| −0.717 | 0.050 | 1.231 |
| −0.705 | 0.037 | 1.231 |
| −0.690 | 0.022 | 1.231 |
| −0.673 | 0.004 | 1.231 |
| −0.653 | −0.017 | 1.231 |
| −0.629 | −0.041 | 1.231 |
| −0.601 | −0.068 | 1.231 |
| −0.570 | −0.097 | 1.231 |
| −0.534 | −0.127 | 1.231 |
| −0.494 | −0.160 | 1.231 |
| −0.452 | −0.193 | 1.231 |
| −0.406 | −0.226 | 1.231 |
| −0.358 | −0.259 | 1.231 |
| −0.307 | −0.292 | 1.231 |

-continued

| X-LOC | Y-LOC | Z-LOC |
|---|---|---|
| −0.253 | −0.323 | 1.231 |
| −0.196 | −0.354 | 1.231 |
| −0.136 | −0.383 | 1.231 |
| −0.075 | −0.411 | 1.231 |
| −0.013 | −0.437 | 1.231 |
| 0.050 | −0.460 | 1.231 |
| 0.114 | −0.482 | 1.231 |
| 0.178 | −0.501 | 1.231 |
| 0.243 | −0.518 | 1.231 |
| 0.307 | −0.534 | 1.231 |
| 0.372 | −0.548 | 1.231 |
| 0.438 | −0.560 | 1.231 |
| 0.503 | −0.571 | 1.231 |
| 0.569 | −0.580 | 1.231 |
| 0.633 | −0.588 | 1.231 |
| 0.695 | −0.594 | 1.231 |
| 0.755 | −0.599 | 1.231 |
| 0.813 | −0.603 | 1.231 |
| 0.868 | −0.605 | 1.231 |
| 0.922 | −0.607 | 1.231 |
| 0.974 | −0.608 | 1.231 |
| 1.023 | −0.608 | 1.231 |
| 1.067 | −0.607 | 1.231 |
| 1.108 | −0.606 | 1.231 |
| 1.143 | −0.604 | 1.231 |
| 1.177 | −0.603 | 1.231 |
| 1.206 | −0.601 | 1.231 |
| 1.228 | −0.600 | 1.231 |
| 1.246 | −0.598 | 1.231 |
| 1.260 | −0.597 | 1.231 |
| 1.269 | −0.601 | 1.231 |
| 1.273 | −0.605 | 1.231 |
| 1.274 | −0.608 | 1.231 |
| 1.275 | −0.610 | 1.231 |
| 1.275 | −0.611 | 1.231 |
| 1.275 | −0.611 | 1.231 |
| 1.331 | −0.676 | 1.379 |
| 1.331 | −0.677 | 1.379 |
| 1.331 | −0.679 | 1.379 |
| 1.330 | −0.683 | 1.379 |
| 1.327 | −0.687 | 1.379 |
| 1.317 | −0.692 | 1.379 |
| 1.303 | −0.694 | 1.379 |
| 1.284 | −0.696 | 1.379 |
| 1.260 | −0.698 | 1.379 |
| 1.228 | −0.701 | 1.379 |
| 1.193 | −0.705 | 1.379 |
| 1.154 | −0.709 | 1.379 |
| 1.111 | −0.713 | 1.379 |
| 1.063 | −0.717 | 1.379 |
| 1.010 | −0.720 | 1.379 |
| 0.955 | −0.723 | 1.379 |
| 0.897 | −0.725 | 1.379 |
| 0.837 | −0.726 | 1.379 |
| 0.774 | −0.726 | 1.379 |
| 0.709 | −0.724 | 1.379 |
| 0.642 | −0.721 | 1.379 |
| 0.573 | −0.715 | 1.379 |
| 0.501 | −0.708 | 1.379 |
| 0.430 | −0.698 | 1.379 |
| 0.360 | −0.687 | 1.379 |
| 0.290 | −0.672 | 1.379 |
| 0.220 | −0.656 | 1.379 |
| 0.151 | −0.636 | 1.379 |
| 0.083 | −0.614 | 1.379 |
| 0.015 | −0.589 | 1.379 |
| −0.052 | −0.561 | 1.379 |
| −0.117 | −0.530 | 1.379 |
| −0.180 | −0.496 | 1.379 |
| −0.242 | −0.459 | 1.379 |
| −0.299 | −0.420 | 1.379 |
| −0.353 | −0.379 | 1.379 |
| −0.403 | −0.337 | 1.379 |
| −0.450 | −0.295 | 1.379 |
| −0.492 | −0.253 | 1.379 |
| −0.531 | −0.211 | 1.379 |
| −0.567 | −0.169 | 1.379 |

-continued

| X-LOC | Y-LOC | Z-LOC |
|---|---|---|
| −0.598 | −0.130 | 1.379 |
| −0.625 | −0.093 | 1.379 |
| −0.648 | −0.059 | 1.379 |
| −0.667 | −0.028 | 1.379 |
| −0.683 | −0.001 | 1.379 |
| −0.696 | 0.022 | 1.379 |
| −0.707 | 0.042 | 1.379 |
| −0.716 | 0.060 | 1.379 |
| −0.722 | 0.074 | 1.379 |
| −0.727 | 0.085 | 1.379 |
| −0.731 | 0.095 | 1.379 |
| −0.733 | 0.102 | 1.379 |
| −0.733 | 0.108 | 1.379 |
| −0.732 | 0.112 | 1.379 |
| −0.730 | 0.115 | 1.379 |
| −0.727 | 0.116 | 1.379 |
| −0.722 | 0.114 | 1.379 |
| −0.717 | 0.111 | 1.379 |
| −0.712 | 0.106 | 1.379 |
| −0.706 | 0.099 | 1.379 |
| −0.698 | 0.090 | 1.379 |
| −0.689 | 0.078 | 1.379 |
| −0.677 | 0.064 | 1.379 |
| −0.664 | 0.047 | 1.379 |
| −0.647 | 0.027 | 1.379 |
| −0.628 | 0.003 | 1.379 |
| −0.605 | −0.023 | 1.379 |
| −0.579 | −0.053 | 1.379 |
| −0.549 | −0.086 | 1.379 |
| −0.514 | −0.120 | 1.379 |
| −0.475 | −0.158 | 1.379 |
| −0.434 | −0.195 | 1.379 |
| −0.389 | −0.232 | 1.379 |
| −0.342 | −0.269 | 1.379 |
| −0.292 | −0.306 | 1.379 |
| −0.238 | −0.342 | 1.379 |
| −0.181 | −0.377 | 1.379 |
| −0.121 | −0.411 | 1.379 |
| −0.059 | −0.443 | 1.379 |
| 0.004 | −0.473 | 1.379 |
| 0.068 | −0.501 | 1.379 |
| 0.133 | −0.525 | 1.379 |
| 0.198 | −0.548 | 1.379 |
| 0.264 | −0.568 | 1.379 |
| 0.330 | −0.586 | 1.379 |
| 0.397 | −0.603 | 1.379 |
| 0.464 | −0.617 | 1.379 |
| 0.532 | −0.629 | 1.379 |
| 0.600 | −0.640 | 1.379 |
| 0.666 | −0.649 | 1.379 |
| 0.730 | −0.656 | 1.379 |
| 0.792 | −0.662 | 1.379 |
| 0.852 | −0.666 | 1.379 |
| 0.910 | −0.670 | 1.379 |
| 0.965 | −0.671 | 1.379 |
| 1.019 | −0.672 | 1.379 |
| 1.070 | −0.672 | 1.379 |
| 1.116 | −0.672 | 1.379 |
| 1.158 | −0.671 | 1.379 |
| 1.195 | −0.669 | 1.379 |
| 1.230 | −0.667 | 1.379 |
| 1.260 | −0.665 | 1.379 |
| 1.283 | −0.664 | 1.379 |
| 1.301 | −0.663 | 1.379 |
| 1.315 | −0.662 | 1.379 |
| 1.325 | −0.665 | 1.379 |
| 1.329 | −0.669 | 1.379 |
| 1.330 | −0.672 | 1.379 |
| 1.331 | −0.674 | 1.379 |
| 1.331 | −0.675 | 1.379 |
| 1.331 | −0.675 | 1.379 |
| 1.374 | −0.735 | 1.474 |
| 1.374 | −0.736 | 1.474 |
| 1.374 | −0.738 | 1.474 |
| 1.373 | −0.742 | 1.474 |
| 1.369 | −0.747 | 1.474 |
| 1.359 | −0.752 | 1.474 |

-continued

| X-LOC | Y-LOC | Z-LOC |
|---|---|---|
| 1.345 | −0.753 | 1.474 |
| 1.325 | −0.755 | 1.474 |
| 1.300 | −0.758 | 1.474 |
| 1.269 | −0.761 | 1.474 |
| 1.232 | −0.765 | 1.474 |
| 1.193 | −0.768 | 1.474 |
| 1.148 | −0.772 | 1.474 |
| 1.099 | −0.776 | 1.474 |
| 1.045 | −0.779 | 1.474 |
| 0.988 | −0.782 | 1.474 |
| 0.929 | −0.783 | 1.474 |
| 0.868 | −0.784 | 1.474 |
| 0.804 | −0.783 | 1.474 |
| 0.737 | −0.781 | 1.474 |
| 0.669 | −0.776 | 1.474 |
| 0.597 | −0.770 | 1.474 |
| 0.524 | −0.761 | 1.474 |
| 0.452 | −0.750 | 1.474 |
| 0.380 | −0.737 | 1.474 |
| 0.309 | −0.721 | 1.474 |
| 0.238 | −0.702 | 1.474 |
| 0.168 | −0.680 | 1.474 |
| 0.098 | −0.656 | 1.474 |
| 0.030 | −0.628 | 1.474 |
| −0.037 | −0.597 | 1.474 |
| −0.102 | −0.563 | 1.474 |
| −0.166 | −0.526 | 1.474 |
| −0.227 | −0.485 | 1.474 |
| −0.284 | −0.443 | 1.474 |
| −0.338 | −0.399 | 1.474 |
| −0.387 | −0.355 | 1.474 |
| −0.433 | −0.310 | 1.474 |
| −0.474 | −0.265 | 1.474 |
| −0.512 | −0.220 | 1.474 |
| −0.547 | −0.176 | 1.474 |
| −0.577 | −0.134 | 1.474 |
| −0.603 | −0.095 | 1.474 |
| −0.625 | −0.059 | 1.474 |
| −0.644 | −0.027 | 1.474 |
| −0.659 | 0.001 | 1.474 |
| −0.671 | 0.025 | 1.474 |
| −0.682 | 0.046 | 1.474 |
| −0.690 | 0.064 | 1.474 |
| −0.696 | 0.079 | 1.474 |
| −0.701 | 0.091 | 1.474 |
| −0.704 | 0.100 | 1.474 |
| −0.706 | 0.108 | 1.474 |
| −0.706 | 0.114 | 1.474 |
| −0.705 | 0.119 | 1.474 |
| −0.703 | 0.121 | 1.474 |
| −0.699 | 0.122 | 1.474 |
| −0.695 | 0.120 | 1.474 |
| −0.690 | 0.117 | 1.474 |
| −0.685 | 0.112 | 1.474 |
| −0.679 | 0.104 | 1.474 |
| −0.671 | 0.095 | 1.474 |
| −0.662 | 0.082 | 1.474 |
| −0.651 | 0.067 | 1.474 |
| −0.638 | 0.048 | 1.474 |
| −0.623 | 0.027 | 1.474 |
| −0.604 | 0.002 | 1.474 |
| −0.582 | −0.026 | 1.474 |
| −0.557 | −0.058 | 1.474 |
| −0.527 | −0.093 | 1.474 |
| −0.494 | −0.130 | 1.474 |
| −0.456 | −0.170 | 1.474 |
| −0.415 | −0.210 | 1.474 |
| −0.372 | −0.250 | 1.474 |
| −0.325 | −0.290 | 1.474 |
| −0.275 | −0.330 | 1.474 |
| −0.222 | −0.369 | 1.474 |
| −0.165 | −0.408 | 1.474 |
| −0.105 | −0.445 | 1.474 |
| −0.043 | −0.480 | 1.474 |
| 0.020 | −0.513 | 1.474 |
| 0.084 | −0.543 | 1.474 |
| 0.150 | −0.570 | 1.474 |

-continued

| X-LOC | Y-LOC | Z-LOC |
|---|---|---|
| 0.217 | −0.595 | 1.474 |
| 0.284 | −0.617 | 1.474 |
| 0.351 | −0.637 | 1.474 |
| 0.419 | −0.655 | 1.474 |
| 0.488 | −0.671 | 1.474 |
| 0.557 | −0.685 | 1.474 |
| 0.626 | −0.697 | 1.474 |
| 0.694 | −0.707 | 1.474 |
| 0.759 | −0.715 | 1.474 |
| 0.822 | −0.721 | 1.474 |
| 0.884 | −0.725 | 1.474 |
| 0.943 | −0.729 | 1.474 |
| 1.000 | −0.731 | 1.474 |
| 1.054 | −0.732 | 1.474 |
| 1.107 | −0.732 | 1.474 |
| 1.154 | −0.731 | 1.474 |
| 1.197 | −0.730 | 1.474 |
| 1.235 | −0.729 | 1.474 |
| 1.270 | −0.727 | 1.474 |
| 1.301 | −0.725 | 1.474 |
| 1.325 | −0.723 | 1.474 |
| 1.344 | −0.722 | 1.474 |
| 1.358 | −0.721 | 1.474 |
| 1.368 | −0.724 | 1.474 |
| 1.372 | −0.728 | 1.474 |
| 1.374 | −0.732 | 1.474 |
| 1.374 | −0.733 | 1.474 |
| 1.374 | −0.734 | 1.474 |
| 1.374 | −0.735 | 1.474 |

It will also be appreciated that the airfoil disclosed in the above table may be scaled up or down geometrically for use in other similar compressor designs. Consequently, the coordinate values set forth in Table I may be scaled upwardly or downwardly such that the airfoil profile shape remains unchanged. A scaled version of the coordinates in Table I would be represented by X, Y and Z coordinate values multiplied or divided by the same constant or number.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A stator blade for a compressor having an airfoil, the airfoil having a shape in an envelope within ±0.100 inches in a direction normal to any airfoil surface location wherein the airfoil has an uncoated nominal profile substantially in accordance with Cartesian coordinate values of X, Y and Z set forth in inches in Table I wherein the Z coordinate values are perpendicular distances from planes normal to a radius from the compressor centerline and containing the X and Y values with the Z value commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil shape.

2. A stator blade according to claim 1, forming part of a twelfth stage of a compressor.

3. A blade according to claim 1, wherein the Z=0 value commences at a radial distance of 17.114 inches from the compressor centerline and the Z values are increasingly positive in Table I in a radially inward direction.

4. A stator blade for a compressor having an airfoil, the airfoil having an uncoated nominal airfoil profile substantially in accordance with Cartesian coordinate values of X, Y and Z set forth in inches in Table I, wherein the Z coordinate values are perpendicular distances from planes normal to a radius from the compressor centerline and containing the X and Y values with the Z values commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil profile, the X, Y and Z values being scaled as a function of the same constant or number to provide a scaled-up or scaled-down compressor airfoil.

5. A stator blade according to claim 4, forming part of the twelfth stage of the compressor.

6. A blade according to claim 4, wherein the Z=0 value commences at a radial distance of 17.114 inches from the compressor centerline and the Z values are increasingly positive in a radially inward direction.

7. A compressor comprising a plurality of stator blades forming a portion of a compressor stage, each of said blades being in the shape of an airfoil within ±0.100 inches in a direction normal to any airfoil surface location wherein the airfoil has an uncoated nominal profile substantially in accordance with Cartesian coordinate values of X, Y and Z set forth in inches in Table I, wherein the Z coordinate values are perpendicular distances from planes normal to a radius from the compressor centerline and containing the X and Y values with the Z values commencing at zero in the X, Y plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil shape.

8. A compressor according to claim 7, wherein the compressor stage is the twelfth stage.

9. A compressor according to claim 7, wherein the Z=0 value commences at a radial distance of 17.114 inches from the compressor centerline and the Z values are increasingly positive in a radially inward direction.

10. A compressor comprising a plurality of stator blades forming a portion of a compressor stage, each of said blades having an uncoated nominal profile substantially in accordance with Cartesian coordinate values of X, Y and Z set forth in inches in Table I, wherein the Z coordinate values are perpendicular distances from planes normal to a radius from the compressor centerline and containing the X and Y values with the Z value commencing at zero in the X, Y-plane at a radial aerodynamic section of the airfoil and X and Y are coordinate values which, when connected by smooth continuing arcs, define the airfoil profile at each distance Z, the profiles at the Z distances being joined smoothly with one another to form the complete airfoil profile, the X, Y and Z values being scaled as a function of the same constant or number to provide a scaled-up or scaled-down compressor airfoil.

11. A compressor according to claim 10, wherein the compressor stage is the twelfth stage.

12. A compressor according to claim 10, wherein the Z=0 value commences at a radial distance of 17.114 inches from the compressor centerline and the Z values are increasingly positive in a radially inward direction.

* * * * *